US005576675A

United States Patent [19]

Oldfield

[11] Patent Number: 5,576,675

[45] Date of Patent: Nov. 19, 1996

[54] MICROWAVE CONNECTOR WITH AN INNER CONDUCTOR THAT PROVIDES AN AXIALLY RESILIENT COAXIAL CONNECTION

[75] Inventor: William W. Oldfield, Redwood City, Calif.

[73] Assignee: Wiltron Company, Morgan Hill, Calif.

[21] Appl. No.: 498,181

[22] Filed: Jul. 5, 1995

[51] Int. Cl.[6] ..... H01P 1/04

[52] U.S. Cl. ..... 333/260; 439/578; 439/824

[58] Field of Search ..... 333/243, 260, 333/245; 439/63, 578, 824

[56] References Cited

U.S. PATENT DOCUMENTS 3,245,027 4/1966 Ziegler, Jr. ..... 333/260 X 3,579,282 5/1971 Couper ..... 333/260

5,276,415 1/1994 Lewandowski et al. ..... 333/260

*Primary Examiner*—Paul Gensler

*Attorney, Agent, or Firm*—Fliesler, Dubb, Meyer & Lovejoy

[57] ABSTRACT

An inner conductor for a high frequency microwave coaxial connector comprising a cylindrical conducting member with a central bore and slots that form fingers, and a cylindrical pressure contact member that is inserted in the cylindrical conducting member. The cylindrical pressure contact member has a tapered end so that when the fingers of the cylindrical conducting member contacts the tapered end, axial pressure is produced along a central axis of the cylindrical pressure contact member to force the cylindrical pressure contact member out of the central bore of the cylindrical conducting member to thereby produce an axially resilient coaxial connection with another microwave device.

16 Claims, 6 Drawing Sheets

MICROWAVE CONNECTOR WITH AN INNER CONDUCTOR THAT PROVIDES AN AXIALLY RESILIENT COAXIAL CONNECTION

BACKGROUND OF THE INVENTION

1. Field of the Invention

The present invention relates to microwave connectors used to connect coaxial conductors to microwave components, In particular, the present invention relates to an inner conductor for a coaxial microwave connector designed to provide an axially resilient connection with microwave devices at high microwave frequencies.

2. Description of the Related Art

FIG. 1A shows a microwave coaxial transmission line 10 which requires two contacts for connection with a microwave device. One contact is an outer conductor 20 and the other contact is an inner conductor 30. Both of these conductors form an axial connection with a microwave device. That is, to make a pressure connection with the microwave device, pressure is provided in the direction of the central axis 40 of the inner 30 and outer 20 conductors.

In an axial connection, only one of the contacts can be firm, while the other contact must be resilient as depicted in FIG. 1B. FIG. 1B is a side view of outer conductors 20 and inner conductors 30 of two microwave coaxial transmission lines that are to be connected, A firm connection 50 exists between the outer conductors 20 while a resilient connection 60 exists between the inner conductors 30. The resilient connection 60 is necessary to absorb the variations in the relationship between the outer 20 and inner 30 conductors. Additionally, the resilient connection 60 must be maintained at a constant impedance. To maintain a constant impedance, a requisite amount of axial pressure 70 must be provided by the inner conductors 30.

The requisite amount of axial pressure 70 is difficult to maintain at microwave frequencies because, as the frequency of the operation of a microwave device increases, the parts in a microwave coaxial line must be very small. The diameter of the coaxial line must be reduced as the frequency of the operation increases. Thus, as microwave devices move to higher frequencies, their parts must necessarily get smaller, and the designs of the larger, low-frequency connectors become infeasible. When connector sizes are reduced, the requisite axial pressure needed to maintain a stable connection becomes more difficult to provide.

Conventional inner conductors of coaxial connectors have been used as shown in prior art FIGS. 2A–2C to provide an axially resilient coaxial connection between a conventional inner conductor and a microwave device at microwave frequencies. However, as described below, the parts used in these conventional inner conductors at microwave frequencies are too small to provide the necessary axial pressure to maintain the requisite pressure.

Prior art FIG. 2A shows a side view of a first conventional inner conductor 80 for a coaxial connector known as a GPC-7 connector. A first portion 100 of the first conventional inner conductor 80 has been removed in the side view so that a first resilient contact 110 located within a first bore 90 through the first conventional inner conductor 80 may be viewed. The first conventional inner conductor 80 has a metal barrel 111 with barrel slots 112 extending along the metal barrel 111. The first conventional inner conductor 80 has lips 120 to hold the metal barrel 111. In operation, the barrel slots 112 expand into the first bore 90 to make electrical contact when inserted therein. Such an inner conductor configuration, however, becomes impractical to manufacture for small sizes required at high microwave frequencies.

Prior art FIG. 2B shows a second conventional inner conductor 121 of a conventional coaxial connector. A second portion 130 of the second conventional inner conductor 121 has been removed to view a second resilient contact 140 located within a second bore 150 through the second conventional inner conductor 121. The second resilient contact 140 is composed of a spring 160 connected to a contact plunger 170. The spring 160 maintains contact against the contact plunger 170 to provide axial pressure 180 and thereby maintain a constant impedance against a microwave device (not shown). Resiliency is provided by the spring 160 that provides axial pressure 180 and maintains a constant impedance. The problem with the second conventional inner conductor 121 is that, at microwave frequencies, the spring 160 must be very small and becomes difficult to manufacture, and if such a small spring is available, axial pressure 180 provided by the small spring 160 is not sufficient to maintain the requisite pressure.

Prior art FIG. 2C shows a third conventional inner conductor 190. A third portion 200 of the third conventional inner conductor 190 has been removed to view a third resilient contact 210 located within a third bore 220 through the third conventional inner conductor 190. The third resilient contact 210 is a thin wall bellow which functions as a spring to provide axial pressure 240 to maintain a constant impedance with a microwave device. However, manufacturing such thin walled bellows becomes impractical and expensive when frequencies are significantly increased.

It is, therefore, desirable to have an inner conductor for a high frequency microwave coaxial connector that maintains sufficient axial pressure for a constant impedance while providing an axially resilient coaxial connection with a microwave device. Since operation of the microwave device is at microwave frequencies, the connector must be able to provide the axial pressure and constant impedance with very small parts.

SUMMARY OF THE INVENTION

The present invention enables an inner conductor of a microwave coaxial connector to maintain an axially resilient coaxial connection with a microwave device at high microwave frequencies.

The present invention enables providing sufficient axial pressure to maintain a constant impedance between an inner conductor and a microwave device using very small connector parts at high microwave frequencies.

The present invention includes an inner conductor with a cylindrical conducting member having a center bore and slots forming fingers. The cylindrical conducting member has a cylindrical pressure contact member inserted into the central bore. The cylindrical pressure contact member has a tapered end, so when the cylindrical conducting member is inserted into the central bore of the cylindrical conducting member, the tapered end contacts the fingers to thereby produce pressure along a central axis of the cylindrical pressure contact member to force the cylindrical pressure contact member out of the central bore.

The inner conductor forms part of a microwave coaxial connector assembly for mating with the microwave device. The microwave coaxial connector assembly additionally comprises a cylindrical outer conductor encasing the inner conductor.

The microwave coaxial connector assembly may be used in a system for connecting a microwave device to be tested, comprising a network analyzer, a microwave device, and the microwave coaxial connector assembly connecting the network analyzer to the microwave device.

Other aspects and advantages of the present invention can be seen upon review of the figures, the detailed description, and the claims which follow.

BRIEF DESCRIPTION OF THE DRAWINGS

Further details of the present invention are explained with the help of the attached drawings in which.

DETAILED DESCRIPTION OF THE INVENTION

Figure 1A:
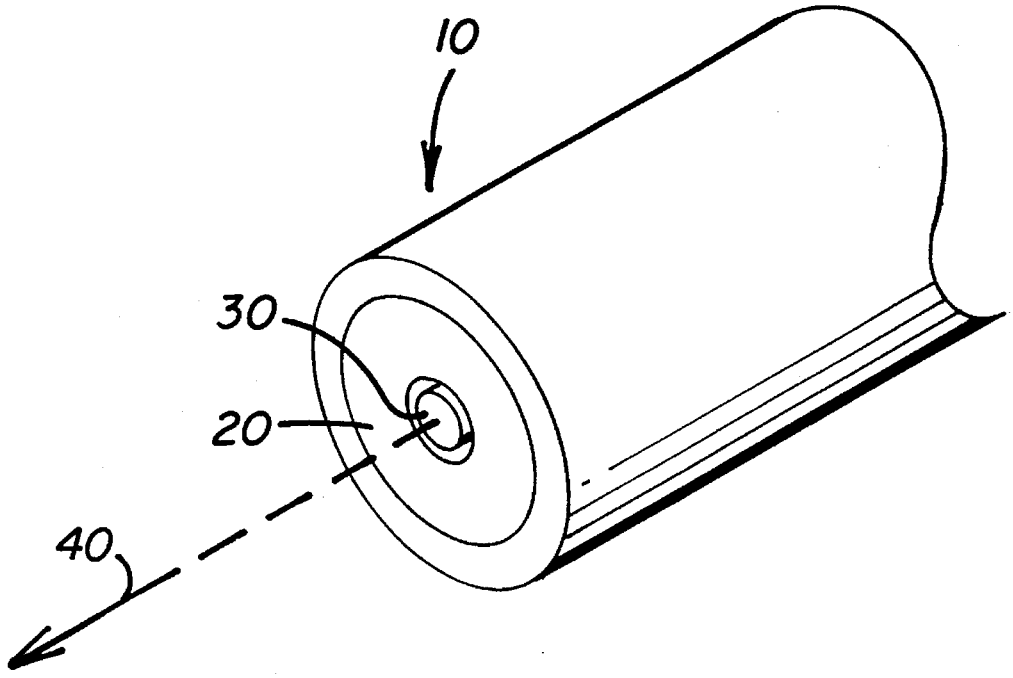
FIG. 1A (PRIOR ART)
FIG. 1A illustrates a perspective view of a coaxial transmission line.
Figure 1B:
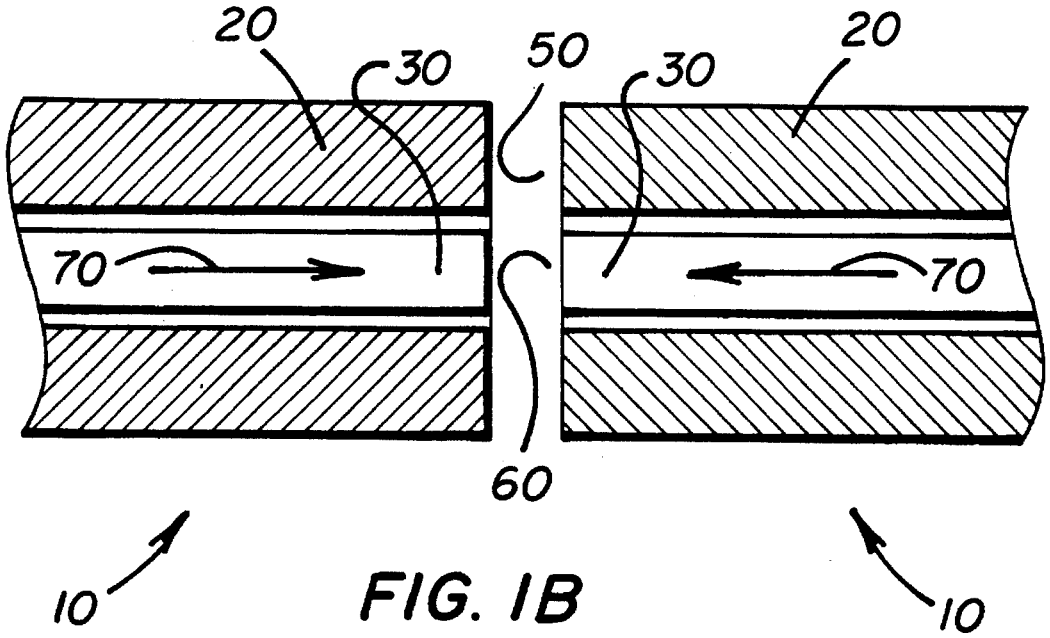
FIG. 1B (PRIOR ART)
FIG. 1B illustrates a side view of two coaxial transmission lines.
Figure 2A:
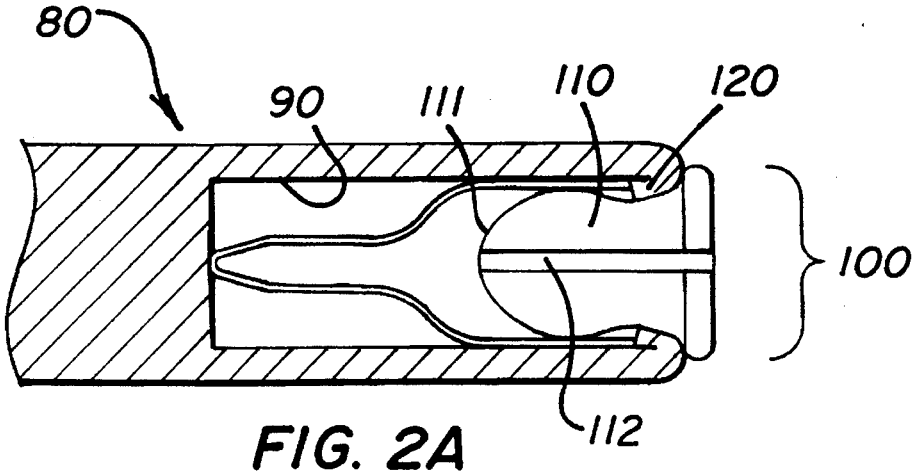
FIG. 2A (PRIOR ART)
FIG. 2A illustrates a side view of a prior art first conventional inner conductor of a microwave coaxial connector.
Figure 2B:
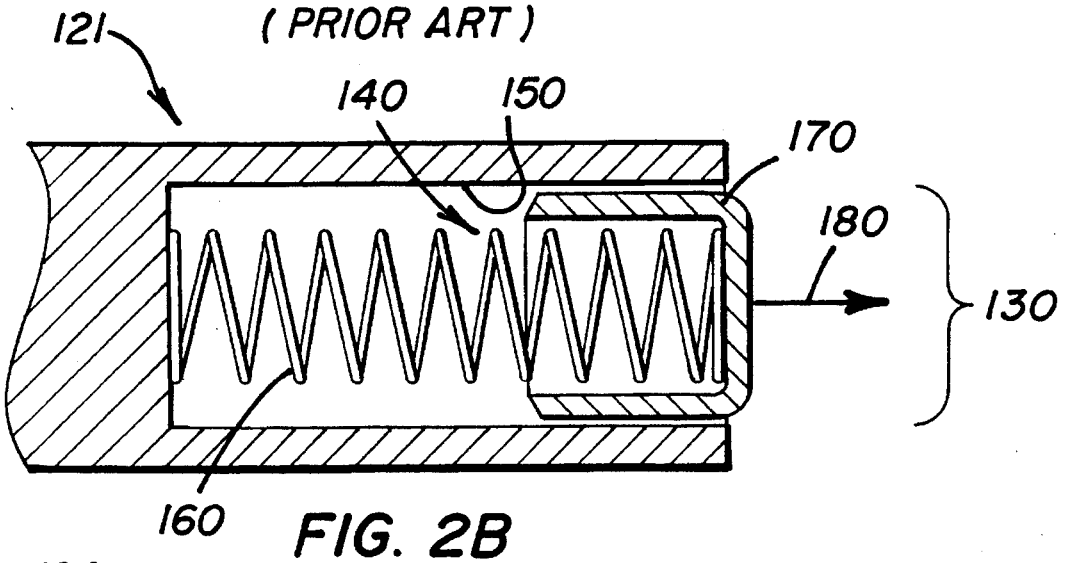
FIG. 2B (PRIOR ART)
FIG. 2B illustrates a side view of a prior art second conventional inner conductor of a microwave coaxial connector.
Figure 2C:
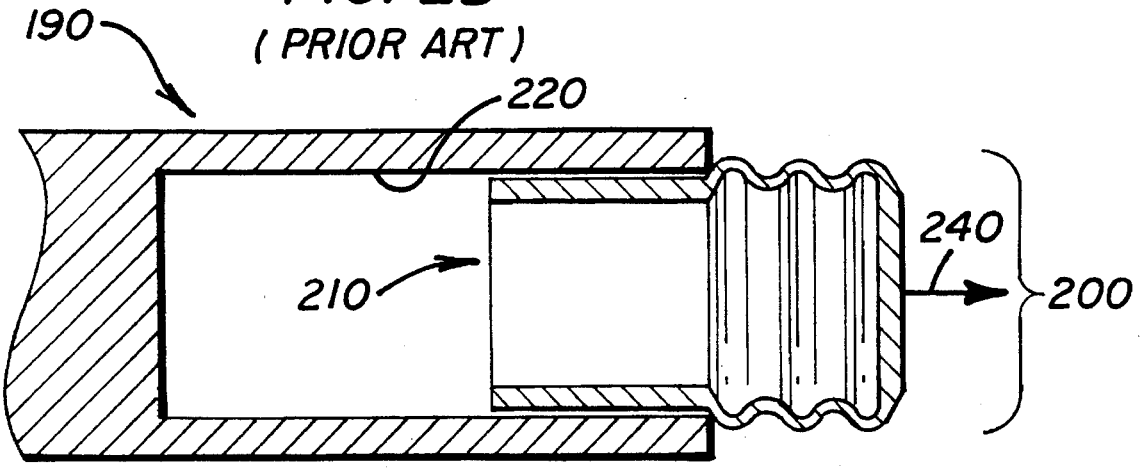
FIG. 2C (PRIOR ART)
FIG. 2C illustrates a side view of a prior art third conventional inner conductor of a microwave coaxial connector.
Figure 3:
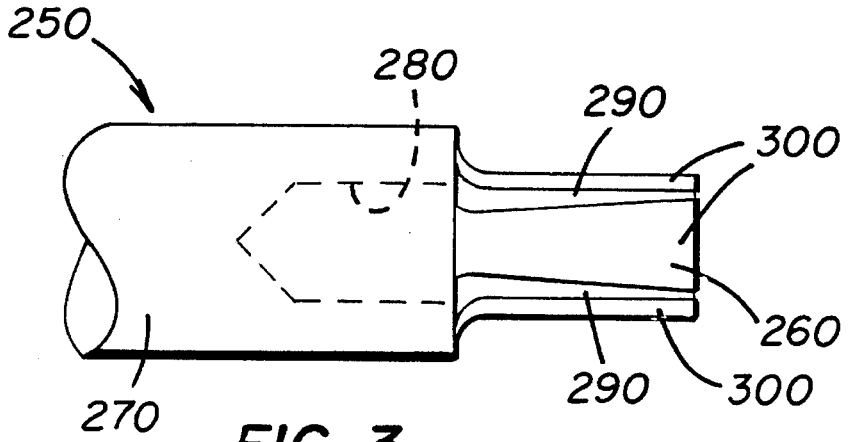
FIG. 3 illustrates a side view of the cylindrical conducting member of the inner conductor of the microwave coaxial connection assembly of the present invention without the cylindrical pressure contact member.

FIG. 3 shows a side view of the cylindrical conducting member 250 of the inner conductor for a coaxial connector of the present invention. The cylindrical conducting member 250 has a proximal end 260 and a distal end 270. A central bore 280 is located from the proximal end 260 extending towards the distal end 270 of the cylindrical conducting member 250. Slots 290 extend longitudinally from the proximal end 260 toward the distal end 270. While two slots 290 are depicted in the side view of the cylindrical conducting member 250 of FIG. 3, it is understood that a total of four slots are used in this embodiment of the present invention. It must also be understood that the number of slots 290 used in the present invention may vary and still fall within the scope of this invention as claimed. The slots 290 form fingers 300 on the cylindrical conducting member 250 from the portion of the cylindrical conducting member located between the slots 290.

Figure 3A:
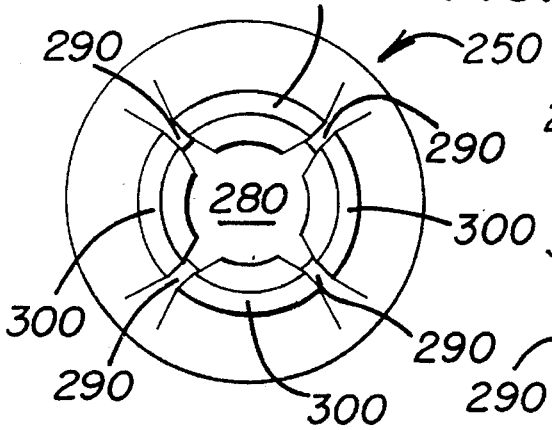
FIG. 3A illustrates a front view of the cylindrical conducting member of the inner conductor of FIG. 3.

FIG. 3A shows a front view of the proximal end 260 of the cylindrical conducting member 250 of the present invention. The slots 290 of the cylindrical conducting member 250 form the fingers 300 of the cylindrical conducting member 250.

Figure 3B:
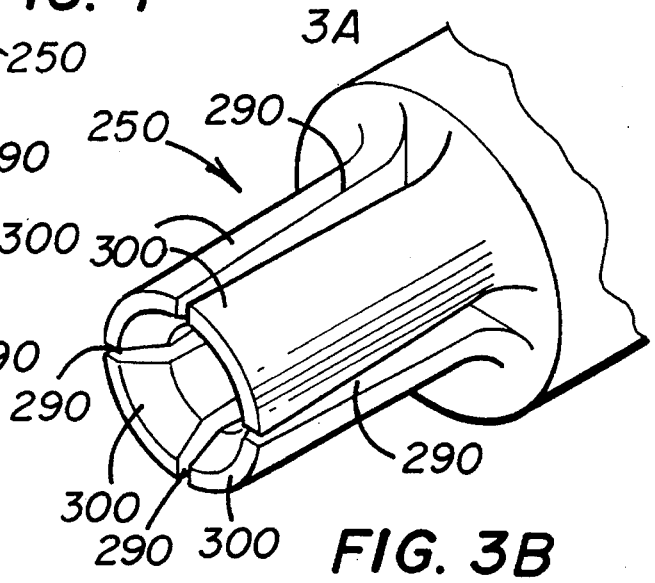
FIG. 3B illustrates a perspective view of the cylindrical conducting member of the inner conductor of FIG. 3.

FIG. 3B shows a perspective view of the proximal end 260 of the cylindrical conducting member 250. The slots 290 form the fingers 300 of the cylindrical conducting member 250.

Figure 4:
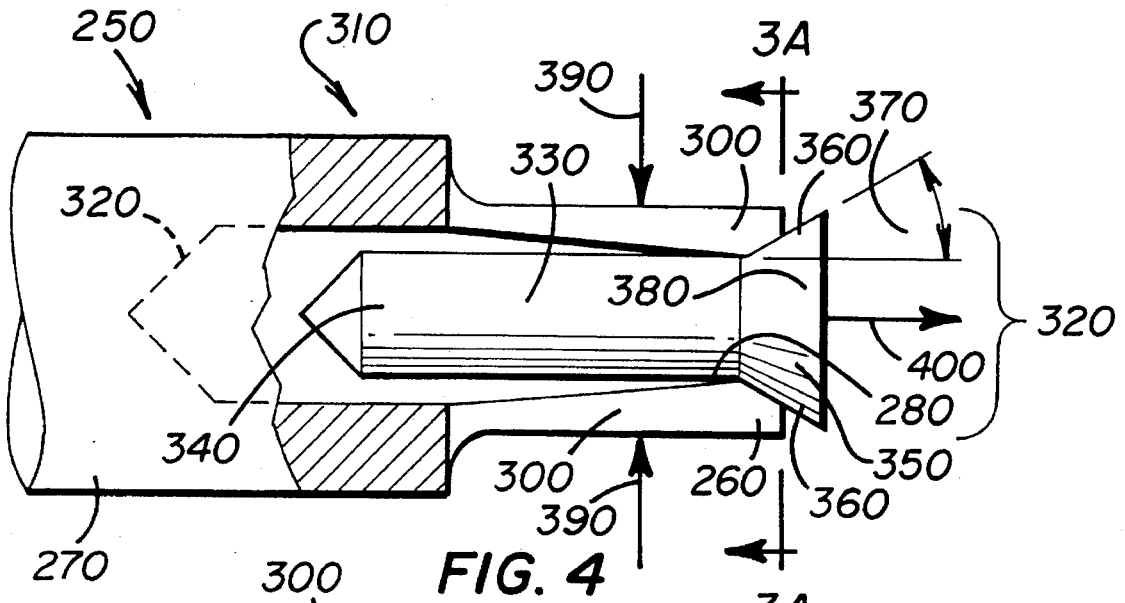
FIG. 4 illustrates a side view of the inner conductor of the microwave coaxial connector assembly of the present invention with the cylindrical pressure contact member inserted.

FIG. 4 shows a cutaway 320 side view of the inner conductor 310 of the present invention with a cylindrical pressure contact member 330 located within the central bore 280 of the cylindrical conducting member 250. The cylindrical pressure contact member 330 has a contact distal end 340 and a contact proximal end 350. At the contact proximal end 350, the cylindrical pressure contact member 330 is tapered 360 to form a tapered contact proximal end 380 with taper angles 370. The degree of taper angles 370 may vary from greater than zero degrees to less than ninety degrees and still fall within the scope of the present invention as that scope is defined in the claims.

In use, the cylindrical pressure contact member 330 is inserted into the central bore 280 of the proximal end 260 of the cylindrical conducting member 250. As the tapered contact proximal end 380 makes contact with the fingers 350, radial pressure in a direction 390 by the fingers 300 is produced toward the center of the central bore 280. The radial pressure of the fingers, in turn, produces axial pressure in a direction 400 perpendicular to the radial pressure direction 390. The axial pressure is in a direction 400 away from the distal end 270 towards the proximal end 260 of the cylindrical conducting member. The axial pressure produces an axially resilient connection between the inner conductor 310 and a microwave device (not shown). The cylindrical pressure contact member 330 is practical and inexpensive to manufacture and provides sufficient axial pressure despite being very small.

The fingers 300 also provide sufficient radial pressure 390 on the cylindrical pressure contact member 330 to maintain cylindrical pressure contact member 380 within the central bore 280 of the cylindrical conducting member 280.

Figure 5:
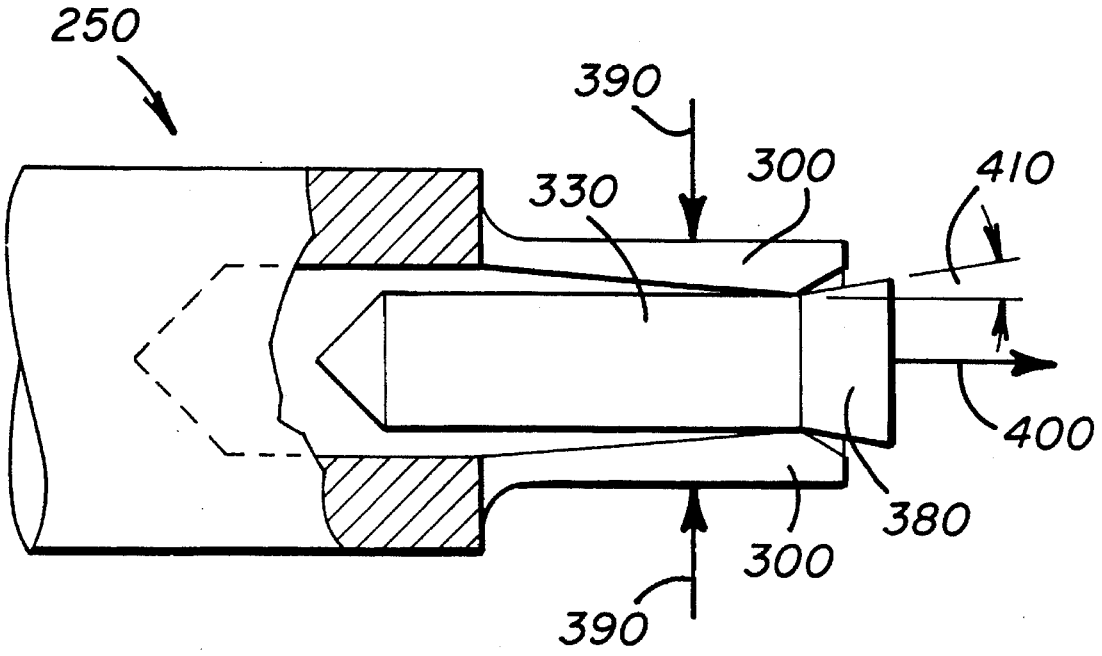
FIG. 5 illustrates a side view of a first embodiment of the inner conductor of the microwave coaxial connector assembly of the present invention.

FIG. 5 shows a side view of a first embodiment of the present invention. The cylindrical pressure contact member 330 has small taper angles 410. A small taper angle 410 is defined as a taper angle from slightly above zero to approximately forty-five degrees. This embodiment produces less contact between the fingers 300 and the tapered contact proximal end 380, resulting in lower radial direction 390 and axial direction 400 pressures. A more resilient connection with a microwave device is achieved using this embodiment, but impedance is not as constant.

Figure 6:
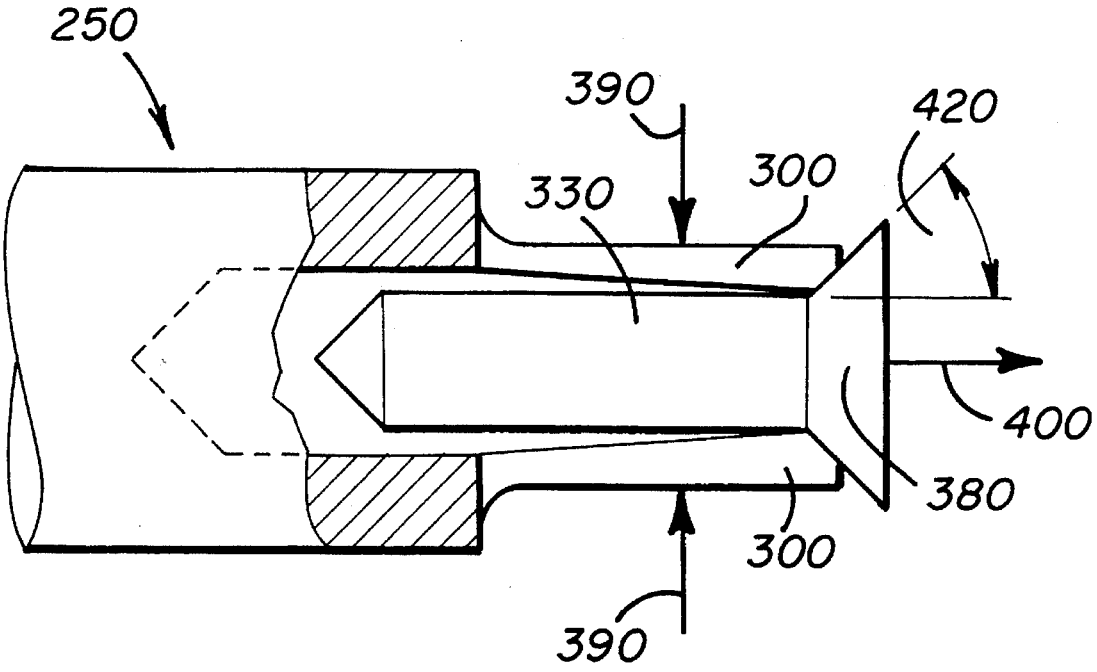
FIG. 6 illustrates a side view of a second embodiment of the inner conductor of the microwave coaxial connector assembly of the present invention.

FIG. 6 shows a side view of a second embodiment of the present invention. The cylindrical pressure contact member 330 has large taper angles 420. A large taper angle is defined as a taper angle between forty-five degrees and slightly less than ninety degrees. This embodiment produces more contact between the fingers 300 and the tapered contact proximal end 380, resulting in higher radial direction 390 and axial direction 400 pressure. A less resilient connection with a microwave device is achieved using this embodiment, but a more constant impedance results.

Figure 7:
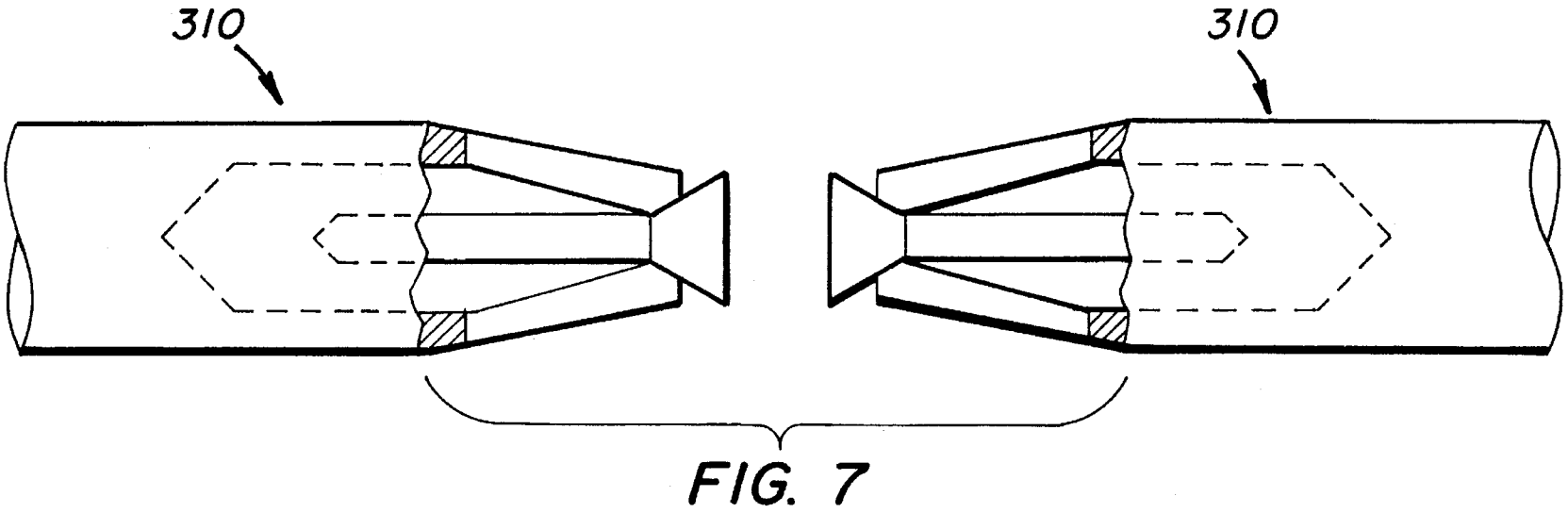
FIG. 7 illustrates a side view of an axially resilient coaxial connection between two inner conductors of the present invention.

FIG. 7 shows a side view of an axially resilient connection between two inner conductors 310 of the present invention.

Figure 8:
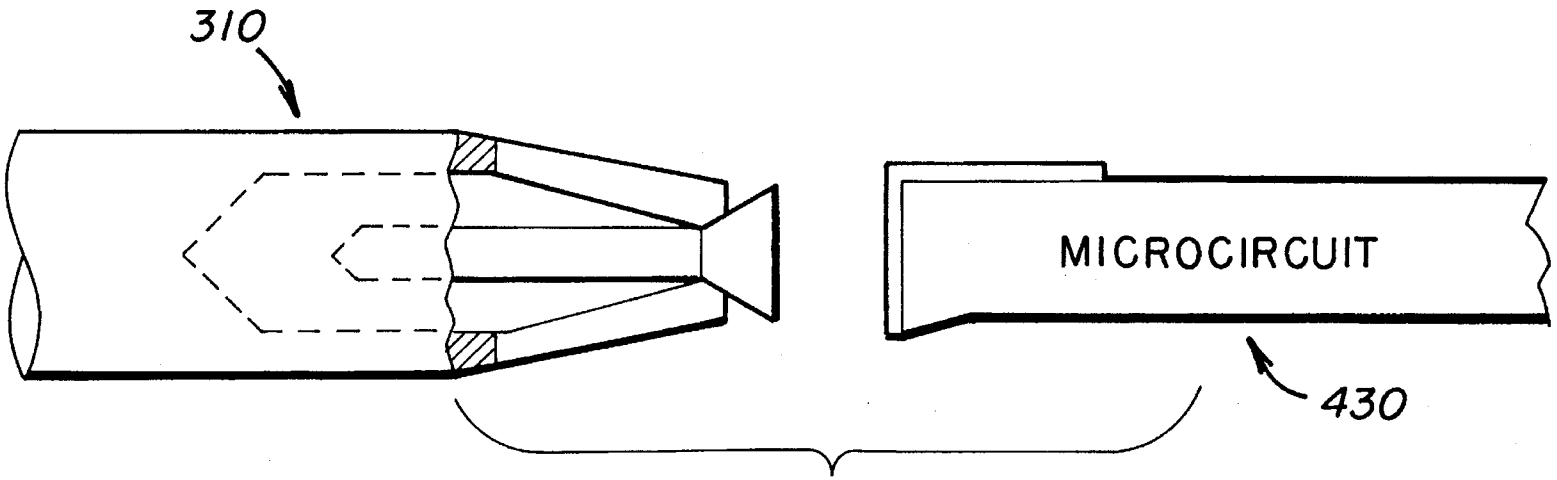
FIG. 8 illustrates a side view of an axially resilient coaxial connection between an inner conductor of the present invention and a microcircuit.

FIG. 8 shows a side view of an axially resilient connection between an inner conductor 310 and a microcircuit 430 which may be a coplanar waveguide or microstrip type circuit.

Figure 9:
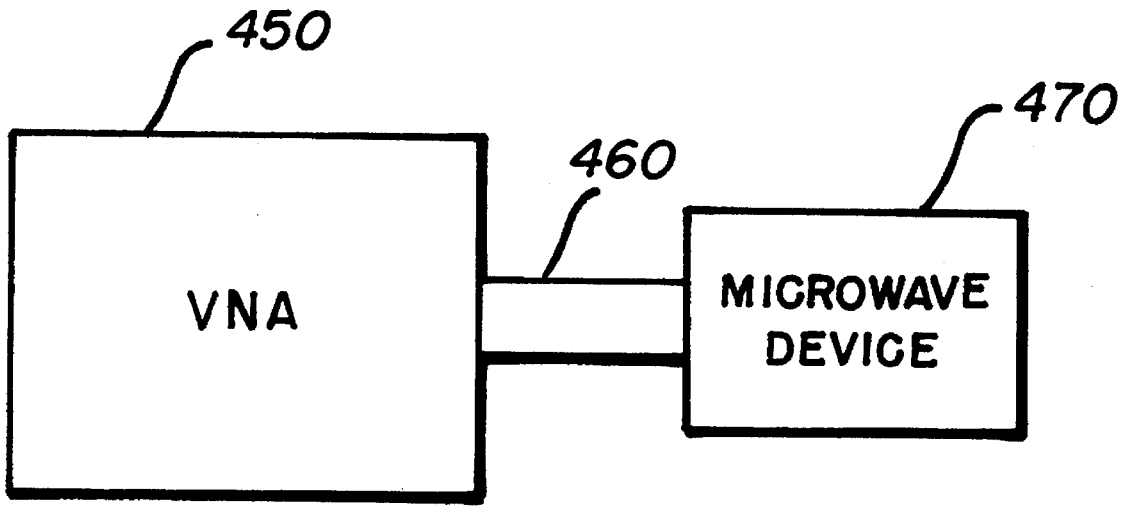
FIG. 9 is a block diagram of a microwave coaxial connector assembly of the present invention in use with a Vector Network Analyzer and a microwave device to be tested.

FIG. 9 shows a block diagram of a microwave system including a vector network analyzer (VNA) 450 with a coaxial connector assembly 460 of the present invention contacting a microwave device 470.

Although the invention has been described above with particularity, this is merely to teach one of ordinary skill in the art how to make and use the invention. Many modifications will fall within the scope of the invention, as the scope is defined by the following claims.

What is claimed is:

1. An inner conductor for a microwave coaxial connector assembly for mating with a microwave device, comprising:

a cylindrical conducting member having a central bore and slots forming fingers; and a cylindrical pressure contact member having a tapered end said cylindrical pressure contact member being inserted into said central bore so that said tapered end contacts said fingers to produce pressure along a central axis of said cylindrical pressure contact member to force said cylindrical pressure contact member out of said central bore as said cylindrical pressure contact member is inserted into said central bore and said tapered end contacts said fingers.

2. The conductor of claim 1 further comprising a cylindrical outer conductor circumjacent about said inner conductor.

3. The conductor of claim 1 wherein said cylindrical conducting member has a proximal end and a distal end, said central bore located from said proximal end to said distal end, and said slots extending longitudinally toward said distal end from said proximal end to form said fingers.

4. The conductor of claim 1 wherein said cylindrical pressure contact member has a contact distal end and a contact proximal end, said contact proximal end being tapered to form said tapered end so that contact between said fingers and said tapered end produces radial pressure on said tapered contact proximal end, said radial pressure directed toward the center of said central bore to produce axial pressure in a direction perpendicular to said radial pressure from said distal end to said proximal end.

5. The conductor of claim 1 wherein said microwave device is a second microwave coaxial connector assembly.

6. The conductor of claim 1 wherein said microwave device is a microcircuit.

7. The conductor of claim 1 wherein said microwave device is a coplanar waveguide.

8. The conductor of Claim 1 wherein said cylindrical conducting member has four slots.

9. A microwave coaxial connector assembly for mating with a microwave device, comprising:

a cylindrical outer conductor;

an inner conductor located within walls of said cylindrical outer conductor, comprising:

a cylindrical conducting member having a proximal end, a distal end, a central bore located from said proximal end to said distal end, and slots extending longitudinally toward said distal end from said proximal end to form fingers; and a cylindrical pressure contact member located within said central bore, said cylindrical pressure contact member having a contact distal end and a contact proximal end, said contact proximal end being tapered, said fingers contacting said tapered contact proximal end to produce radial pressure on said tapered contact proximal end, said radial pressure directed toward the center of said bore to produce axial pressure in a direction perpendicular to said radial pressure from said distal end to said proximal end of said cylindrical pressure contact member.

10. The assembly of claim 9 wherein said microwave device is a second microwave coaxial assembly.

11. The assembly of claim 9 wherein said microwave device is a microcircuit.

12. The assembly of claim 9 wherein said microwave device is a coplanar waveguide.

13. A microwave system, comprising:

a network analyzer;

a microwave device; and a coaxial connector assembly connecting said network analyzer to said microwave device, said coaxial connector assembly comprising:

a cylindrical outer conductor;

a cylindrical inner conductor located within walls of said cylindrical outer conductor, comprising:

a cylindrical conducting member having a proximal end, a distal end, a central bore located from said proximal end to said distal end, and slots extending longitudinally toward said distal end from said proximal end to form fingers; and a cylindrical pressure contact member located within said central bore, said cylindrical pressure contact member having a contact distal end and a contact proximal end, said contact proximal end being tapered, said fingers contacting said tapered contact proximal end to produce radial pressure on said tapered contact proximal end, said radial pressure directed toward the center of said central bore to produce axial pressure in a direction perpendicular to said radial pressure from said distal end to said proximal end of said cylindrical pressure contact member.

14. The system claim of 13 wherein said microwave device is a second coaxial connector assembly.

15. The system of claim 13 wherein said microwave device is a microcircuit.

16. The system of claim 13 wherein said microwave device is a coplanar wave guide.

* * * * *